US005674131A

United States Patent [19]

Forbes et al.

[11] Patent Number: 5,674,131

[45] Date of Patent: Oct. 7, 1997

[54] GOLF CUP INSERT NOVELTY APPARATUS

[76] Inventors: Vaughn T. Forbes, 20615 N. 17th St., Phoenix, Ariz. 85024; Gerald C. Dickerson, 10137 Cheryl, Sun City, Ariz. 85351

[21] Appl. No.: 723,344

[22] Filed: Sep. 30, 1996

[51] Int. Cl.[6] ..... A63B 57/00

[52] U.S. Cl. ..... 473/177

[58] Field of Search ..... 473/176–178, 473/180, 181–184, 186

[56] References Cited

U.S. PATENT DOCUMENTS

| | | | |
|---|---|---|---|
| 1,826,641 | 10/1931 | Waddell | 473/177 |
| 3,310,311 | 3/1967 | Peeples . | |
| 3,467,378 | 9/1969 | English et al. . | |
| 3,792,861 | 2/1974 | Coleman . | |
| 3,897,059 | 7/1975 | McCulloch et al. . | |
| 4,290,603 | 9/1981 | Barnes | 473/177 |
| 4,496,150 | 1/1985 | McGlew | 473/177 |
| 4,552,358 | 11/1985 | McGlew . | |
| 5,018,730 | 5/1991 | Illiuta . | |
| 5,393,053 | 2/1995 | Wiese et al. . | |
| 5,480,142 | 1/1996 | Ackerman . | |

*Primary Examiner*—Mark S. Graham
*Attorney, Agent, or Firm*—H. Gordon Shields

[57] ABSTRACT

A novelty item ejects a golf ball from a cup in a putting green. The golf ball ejector apparatus includes an outer cylinder and an inner cylinder movable relative to the outer cylinder. A compression spring is disposed beneath the inner cylinder and the inner cylinder includes a pair of slots which extend axially along the inner cylinder and a transversely or diametrically extending pin extends through the slots and is secured to the outer cylinder. The top of the inner cylinder includes a recess for receiving the golf ball. The top of the slots include recesses for receiving the pin to lock the inner cylinder downwardly relative to the outer cylinder and a golf ball falling onto the top of the inner cylinder causes the inner cylinder to move relative to the pin, and when the pin is out of the recesses the compression spring moves the inner cylinder, with the golf ball disposed thereon, upwardly to propel or eject the golf ball upwardly and out of the cup.

3 Claims, 1 Drawing Sheet

GOLF CUP INSERT NOVELTY APPARATUS

BACKGROUND OF THE INVENTION

1. Field of the Invention

This invention relates to golf cup novelty and, more particularly, to an insert for a golf cup that will eject the golf ball when the ball falls into the cup.

2. Description of the Prior Art

U.S. Pat. No. 3,310,311 (Peeples) discloses a golf putting cup ejector which fits into the cup on a golf green. The apparatus is relatively complicated and includes electrical elements.

U.S. Pat. No. 3,467,378 (English et al) discloses a device for ejecting a golf ball from the cup on a putting green. Again, the apparatus is relatively complicated, and includes a gearing system and is electrically actuated.

U.S. Pat. No. 3,792,861 (Coleman) discloses a spring actuated apparatus for ejecting a golf ball from a cup. The apparatus is not automatic, but must be specifically actuated in order to propel or project the golf ball upwardly where the golf player may catch the ball without having to stoop down and pick the ball out of the cup.

U.S. Pat. No. 3,897,059 (McCuloch et al) discloses apparatus which automatically ejects a golf ball. The apparatus is spring actuated and causes the ball to be ejected upwardly and laterally so that there is very little, if any, chance of the ball falling back into the cup.

U.S. Pat. No. 4,290,603 (Barnes) discloses another spring actuated golf ball ejecting apparatus. A time delay is used before the ball is ejected, and the force applied to eject the ball may be adjusted.

U.S. Pat. No. 4,496,150 (McGlew) discloses another type of golf ball ejector apparatus. The apparatus is spring actuated. The ball falls onto a sloping plate and then moves downwardly on the plate to a trigger. Contact with the trigger by the ball releases the spring to cause the ball to be ejected.

U.S. Pat. No. 4,552,358 (McGlew) discloses another type of ball ejection apparatus in which fluid pressure on a cylinder adjacent to the cup causes the ball to be ejected upwardly from the cup. A positive movement by the user on a piston moves the piston downwardly to cause fluid pressure in the cylinder beneath the golf ball to eject the ball.

U.S. Pat. No. 5,018,730 (Iliuta) discloses a golf ball ejection system utilizing a sound actuated switch coupled to a solenoid. The solenoid is battery operated.

U.S. Pat. No. 5,393,053 (Wiese et al) discloses another spring actuated golf ball ejector apparatus a golf ball falls into a cup and onto the top of an ejector mounted on a pin. A positive downward movement on the pin moves a compression spring downwardly and when the pin is released, the compression spring moves the pin and the ejector, with the ball on the top, upwardly, and thus outwardly.

U.S. Pat. No. 4,480,142 (Ackerman) discloses a golf cup which receives a golf ball and elevates the golf ball on the cup a predetermined amount. The lifting element is electrically operated.

SUMMARY OF THE INVENTION

The invention described and claimed herein comprises a novelty item for a golf cup which includes an outer cylinder which may be put into a cup on a golf putting green. Within the outer cylinder is a compression spring, and a movable inner cylinder or piston is disposed on the compression spring. The inner cup includes a pair of slots through which extends a pin. The pin extends through the slots in the inner cylinder or piston and is secured to the outer cylinder. The top of the slots in the inner cylinder includes recesses for locking the pin to hold the inner cylinder downwardly. The inner cylinder includes a top cap which extends outwardly beyond the outer cylinder, and the top cap has a slightly concave upper surface for receiving a golf ball. When the golf ball is tapped into the cup, it falls onto the top cap and dislodges the inner cylinder from the pin. The compression spring then causes the inner cylinder to move upwardly, and the golf ball is ejected from the cup.

Among the objects of the present invention are the following:

To provide new and useful novelty apparatus for a golf green;

To provide new and useful apparatus for ejecting a golf ball out of a cup in a putting green;

To provide new and useful spring actuated apparatus for ejecting a golf ball from a cup; and To provide new and useful novelty apparatus having a pair of concentric cylinders for ejecting a golf ball from a cup on a putting green in response to the golf ball being putted into the cup.

DESCRIPTION OF THE PREFERRED EMBODIMENT

Figure 1:
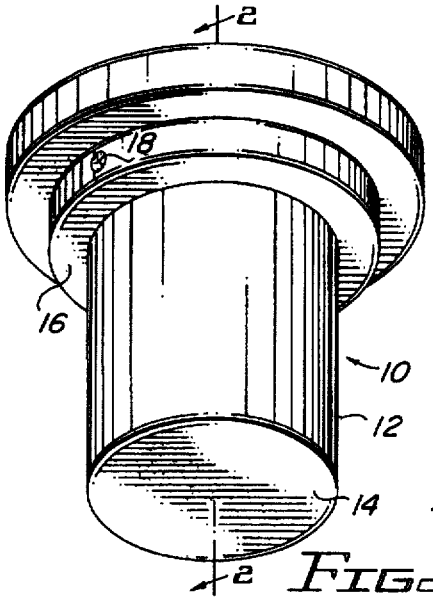
FIG. 1 is a bottom perspective view of the apparatus of the present invention.
Figure 2:
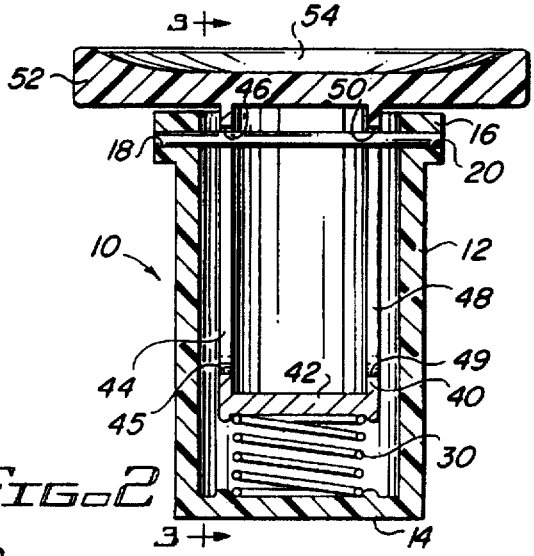
FIG. 2 is a view in partial section taken generally along line 2—2 of FIG. 1.
Figure 3:
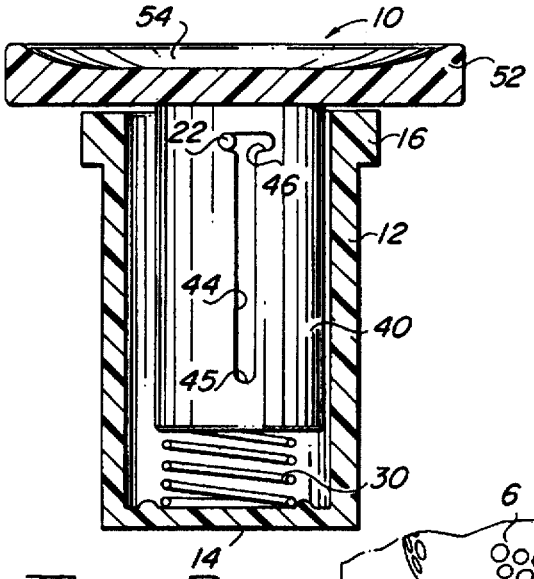
FIG. 3 is a view in partial section taken generally along line 3—3 of FIG. 2.

FIG. 1 is a bottom perspective view of golf novelty apparatus 10 of the present invention. FIG. 2 is a view in partial section taken generally along line 2—2 of FIG. 3, illustrating the various elements involved in the apparatus 10. FIG. 3 is a view in partial section taken generally along line 3—3 of FIG. 2, again illustrating the various elements of the apparatus 10 of the present invention. For the following discussion, reference will primarily be made to FIGS. 1, 2, and 3.

The novelty golf apparatus 10 includes an outer cylinder 12 and a concentric movable inner cylinder 40. The outer cylinder 10 includes a bottom 14 and a top radially outwardly extending flange 16. Extending through the flange 16 are a pair of diametrically aligned apertures or bores 18 and 20. A pin 22 extends through the apertures or bores 18 and 20.

The inner cylinder 40 includes a bottom 42 and a pair of aligned and vertically extending slots 44 and 48. At the top of each slot is a recess. The slot 44 includes a recess 46 and the slot 48 includes a recess 50. The recesses 46 and 50 extend outwardly from the slot. The slot 44 has a bottom 45, and the slot 48 has a bottom 49. The pin 22 moves in the slot, between the top recesses and the bottoms as will be discussed below. To hold the inner cylinder 40 in position relative to the outer cylinder 12, the pin 22 is disposed in the recesses 46 and 50, as shown in FIG. 2.

The inner cylinder 40 may be considered as a piston movable in and above the outer cylinder 12. This will be discussed below in conjunction with FIGS. 4A, 4B, and 4C.

Between the bottom 14 of the outer cylinder 12 and the bottom 42 of the inner cylinder 40 is a compression spring 30. For convenience, the upper portion of the bottom 14 and the lower portion of the bottom 42 include retainer elements for the spring 30. The retainer elements are illustrated as generally circular ridges which help to retain the compression spring 30 in its proper, aligned orientation relative to the two cylinders 12 and 40. The compression spring moves the inner cylinder 12 between the top recesses 46 and 50 and the slot bottoms 45 and 49.

At the top of the inner cylinder 40 is a cap 52. The top cap 52 extends radially outwardly from the timer cylinder 40, and extends outwardly beyond the flange 16 of the outer cylinder 12.

On the top of the cap 52 is a concave recess 54. The concave recess 54 receives a golf ball 6 as the ball is putted into a cup on a golf green. The golf ball 6 causes the pin 22 to move out of the recesses 46 and 50. The bias of the spring 30 then moves the inner cylinder 40 upwardly relative to the outer cylinder 12 until the pin 22 bottoms out on the bottoms 45 and 49 of the slots 44 and 48, respectively. This is shown sequentially in FIGS. 4A, 4B, and 4C.

Figure 4A:
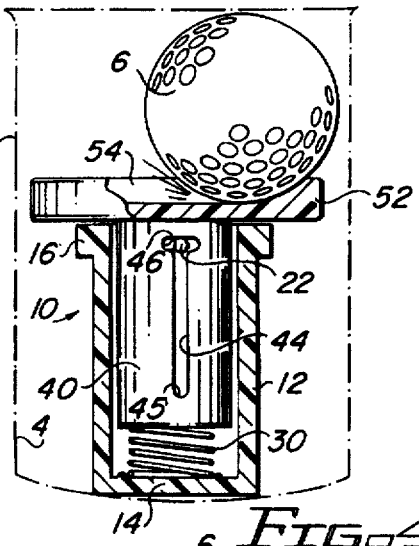
FIGS. 4A, 4B, and 4C sequentially illustrate the operation of the apparatus of the present invention.
Figure 4B:
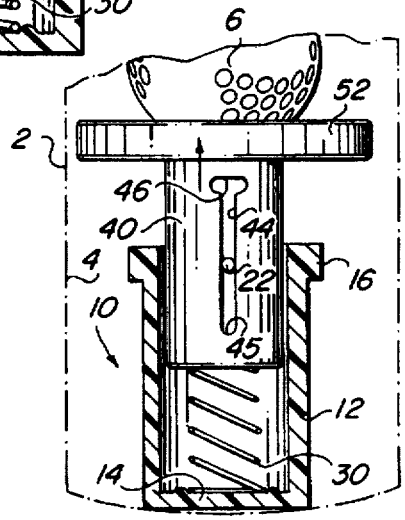
Figure 4C:
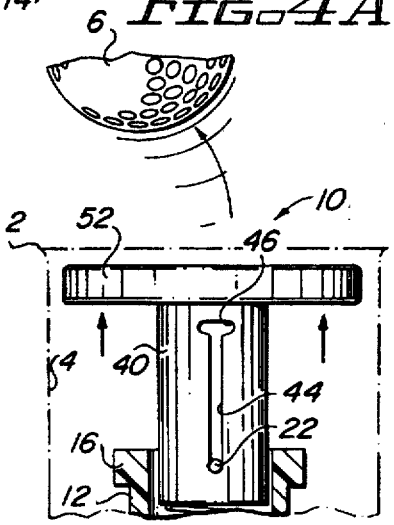

FIGS. 4A, 4B, and 4C sequentially illustrate the operation of the novelty apparatus 10. The apparatus 10 is disposed in a cup 4 in a golf green 2. The apparatus 10 sits very conveniently at the bottom of the cup 4, with the cap 52 below the surface of the green 2.

When the apparatus 10 is in its static position, as illustrated in FIGS. 2 and 3, the pin 22 is in the recesses 46 and 50, as discussed above. When a golf ball 6 lands on the concave recess 54 of the cap 52, the inner cylinder 40 is jiggled slightly such that the pin 22 moves out of the recesses 46 and 50. When the pin moves out of the recesses 46 and 50, which recesses retain the pin so as to hold the inner cylinder 40 in its down position relative to the outer cylinder 12, the compression spring 30 moves the inner cylinder 40 upwardly. This is shown in FIG. 4B.

As the cylinder 40 moves upwardly, the pin 22 is disposed in the aligned slots 44 and 48. When the bottoms 45 and 49 of the slots 44 and 48, respectively, contact the pin 22, the upwardly movement of the inner cylinder 40 ceases. However, the golf ball 6, disposed in the concave recess 54 of the cap 52, continues to move upwardly, as shown in FIG. 4C. Thus, the golf ball 6 appears to jump out of the cup 4.

It will be noted that the outer diameter of the inner cylinder 40 is somewhat less than the inner diameter of the outer cylinder 12, resulting in a relatively sloppy fit between the two cylinders. Accordingly, the inner cylinder 40 is allowed to move somewhat freely relative to the outer cylinder 12, and this movement imparts a sideways movement to the ball 6. In other words, there is sufficient clearance space between the inner cylinder 40 and the outer cylinder 12, and similarly between the pin 22 and the slots 44 and 48, that, under the bias of the compression spring 30, the inner cylinder 40 does not necessarily move in a perfectly vertical manner but rather moves in a generally vertical manner but with sufficient side slop in the movement such that the ball 6 does not move directly upwardly, but moves outwardly as well as upwardly. This results in the golf ball 6 landing on the green 2 adjacent to the cup 4. This may be understood from the arrow in FIG. 4C.

Thus, when a golf player puts into the cup 4, the golf ball 6 will spring out of the cup. The inner cylinder 40 remains in the cup 4. That is, the top cap 52 remains below the top of the cup 4 when it is extended to its full up position, as shown in FIG. 4C. Accordingly, the golf ball 6 appears to have sprung out of the cup 4 of its own volition.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Golf novelty apparatus to be disposed in a cup on a golf green comprising in combination:

an outer cylinder having an upper portion;

a pin extending diametrically through the upper portion;

an inner cylinder disposed in the outer cylinder;

a pair of slots extending vertically in the inner outer cylinder for receiving the pin;

a pair of recesses on the slots for locking the pin;

a top on the inner cylinder for receiving a golf ball;

a compression spring disposed in the outer cylinder and beneath the inner cylinder, wherein a golf ball landing on the top of the inner cylinder moves the inner cylinder relative to the outer cylinder to move the pin out of the recesses and the compression spring moves the inner cylinder upwardly to move the golf ball upwardly.

2. The apparatus of claim 1 in which the slots have a bottom, and the inner cylinder moves upwardly relative to the outer cylinder until the pin contacts the bottom of the slots, wherein the golf ball continues to move upwardly and out of the cup.

3. The apparatus of claim 1 which the outer cylinder has an inner diameter and the inner cylinder has an outer diameter which is less than the inner diameter of the outer cylinder, wherein a sloppy fit between the two cylinders is provided allowing the inner cylinder to move upwardly to cause the golf ball to move upwardly and outwardly relative to the inner and outer cylinders.

* * * * *